US007178601B2

(12) United States Patent
Burge

(10) Patent No.: US 7,178,601 B2
(45) Date of Patent: Feb. 20, 2007

(54) METHODS OF AND APPARATUS FOR CASING A BOREHOLE

(75) Inventor: Philip Michael Burge, Westhill (GB)

(73) Assignee: e2Tech Limited, Houston, TX (US)

( * ) Notice: Subject to any disclaimer, the term of this patent is extended or adjusted under 35 U.S.C. 154(b) by 265 days.

(21) Appl. No.: 10/482,589

(22) PCT Filed: Apr. 24, 2002

(86) PCT No.: PCT/GB02/01879

§ 371 (c)(1),
(2), (4) Date: Jun. 14, 2004

(87) PCT Pub. No.: WO02/086286

PCT Pub. Date: Oct. 31, 2002

(65) Prior Publication Data

US 2004/0221996 A1 Nov. 11, 2004

(30) Foreign Application Priority Data

Apr. 24, 2001 (GB) ..... 0109993.6

(51) Int. Cl.
*E21B 23/00* (2006.01)
*E21B 17/02* (2006.01)
*E21B 7/20* (2006.01)

(52) U.S. Cl. ..... 166/380; 166/242.4; 166/242.6; 166/207; 175/171

(58) Field of Classification Search ..... 166/242.1, 166/207, 380–382, 384, 50, 206, 243, 277, 166/242.4, 242.6; 175/57, 171, 257–259, 175/263, 267, 269, 61, 62, 406
See application file for complete search history.

(56) References Cited

U.S. PATENT DOCUMENTS

| | | | | |
|---|---|---|---|---|
| 5,141,063 | A | 8/1992 | Quesenbury | 175/267 |
| 5,794,702 | A * | 8/1998 | Nobileau | 166/380 |
| 5,957,225 | A * | 9/1999 | Sinor | 175/57 |
| 6,070,671 | A | 6/2000 | Cumming et al. | |
| 6,135,208 | A * | 10/2000 | Gano et al. | 166/313 |
| 6,810,960 | B2 | 11/2004 | Pia | |
| 6,857,486 | B2 * | 2/2005 | Chitwood et al. | 175/104 |
| 6,953,096 | B2 | 10/2005 | Gledhill et al. | |

(Continued)

FOREIGN PATENT DOCUMENTS

| | | |
|---|---|---|
| GB | 2 326 896 | 1/1999 |

(Continued)

OTHER PUBLICATIONS

PCT International Search Report from International App. No. PCT/GB02/01879, Dated Oct. 15, 2002.

*Primary Examiner*—Kenneth Thompson
(74) *Attorney, Agent, or Firm*—Patterson & Sheridan, L.L.P.

(57) ABSTRACT

Methods of and apparatus for drilling, casing and/or completing a borehole wherein one or more portions of the borehole are drilled into a formation at a single diameter along the entire length or depth of the or each portion of the borehole. An expandable tubular member is then located within the or each portion of the borehole and radially expanded in the or each portion to line and/or case it or them. Optionally, a corrosion resistant member and/or a service string can be located in the borehole. An advantage of certain embodiments is that a single diameter borehole is formed along the entire length or depth thereof.

37 Claims, 4 Drawing Sheets

U.S. PATENT DOCUMENTS

| | | | | |
|---|---|---|---|---|
| 7,004,264 | B2 * | 2/2006 | Simpson et al. | 175/57 |
| 7,077,210 | B2 * | 7/2006 | MacKay et al. | 166/380 |
| 2003/0111267 | A1 | 6/2003 | Pia | |
| 2003/0146023 | A1 | 8/2003 | Pia | |
| 2004/0168808 | A1 * | 9/2004 | Smith | 166/313 |
| 2006/0048972 | A1 | 3/2006 | Odell, II et al. | |
| 2006/0185857 | A1 * | 8/2006 | York et al. | 166/384 |

FOREIGN PATENT DOCUMENTS

| | | |
|---|---|---|
| RU | 2 079 633 | 5/1997 |
| WO | WO 99/35368 | 7/1999 |
| WO | WO 00/46484 | 8/2000 |
| WO | WO 00/61914 | 10/2000 |

* cited by examiner

METHODS OF AND APPARATUS FOR CASING A BOREHOLE

CROSS-REFERENCE TO RELATED APPLICATIONS

This application claims benefit of POT International application number

PCT/GB02/01879 filed on Apr. 24, 2002entitled "Method of and Apparatus for Casing a Borehole", which claims benefit of British application serial number 0109993.6, filed on Apr. 24, 2001.

BACKGROUND OF THE INVENTION

1. Field of the Invention

The present invention relates to a method of drilling, casing and/or completing a borehole, and in particular to a method of drilling, casing and/or cladding a borehole. The invention also provides apparatus for completing a borehole. It will be understood that use of the term "borehole" herein is a reference to a bore that has been drilled into a formation to allow the recovery of hydrocarbons (or other fluids) therefrom as is conventional in the art.

2. Description of the Related Art

When a borehole has been drilled into a formation to facilitate, for example, the recovery of hydrocarbons from a well or reservoir, the formation surrounding the borehole is typically lined with a casing. Casing is installed to prevent the formation around the borehole from collapsing, and additionally to prevent unwanted fluids flowing from the surrounding formation into the borehole, and similarly, to prevent fluids from within the borehole escaping into the surrounding formation.

Referring to FIG. 1 there is shown a conventional borehole 10 that has been drilled into a formation 12. It should be noted that FIG. 1 is not to scale. Borehole 10 is drilled with a relatively large diameter at or near surface 14, and it will be appreciated that surface 14 could be below sea level.

A relatively large outer diameter (OD) casing 16 is then inserted into borehole 10 and cemented into place using cement 18 in a conventional manner. The cementing process typically involves filling an annulus between the casing 16 and the surrounding formation 12 with the cement 18 by pumping the cement 18 into the casing 16 followed by a rubber or other plug (not shown) on top of the cement 18. Thereafter, drilling fluid or the like is pumped down the casing 16 above the plug and the cement 18 is pushed out of the bottom of the casing 16 and up into the annulus between the casing 16 and the formation 12, as shown in FIG. 1. Pumping of drilling fluid (and thus the cement 18) is stopped when the plug reaches the bottom of the casing 16 and the borehole 10 must be left, typically for several hours, whilst the cement sets.

Thereafter, a smaller diameter borehole 20 is drilled through the cement 18 into the formation 12 and a subsequent casing 22 of smaller OD than the casing 16 is passed through the casing 16 above and the borehole 20. The diameter of the drill bit that is used to drill borehole 20 is typically smaller than the drill bit used to drill borehole 10, and is typically smaller than an inside diameter (ID) of the casing 16. Casing 22 is then cemented into place using cement 24 in the conventional manner, as described above. The OD of the subsequent casing 22 is limited by the inner diameter of the preceding casing 16. The cement 24 is then left for a further period of several hours to set.

A smaller diameter borehole 26 is then drilled into the cement 24 and into the formation 12, and another casing 28 is then passed through borehole 26 and the casing 22 above. As before, the diameter of the drill bit used to drill borehole 26 is typically smaller than the drill bit used to drill boreholes 10, 20, and typically smaller than the ID of the casing 22. Casing 28 is then cemented into place using cement 30 in the conventional manner described above. The cement 30 is typically left for a further period of several hours to set. The ID of the casing 22 thus limits the OD of casing 28.

Finally, a smaller diameter borehole 32 is drilled into cement 30 and into formation 12, and another casing 34 of smaller OD than casing 28 is passed through casing 28. Again, the diameter of the drill bit used to drill borehole 32 is smaller than those used to drill the preceding boreholes 10, 20, 26, and smaller than the ID of casing 28. Cement 36 is then used to secure casing 34 within borehole 32 using the conventional manner described above. The cement 36 is typically left for a further period of several hours to set.

Thus, the casings 16, 22, 28, 34 are cascaded with the diameters of the successive portions of casing reducing as the depth of the borehole 10, 20, 26, 32 increases. It will be appreciated that the depth of the borehole 10, 20, 26, 32 may be in the order of several kilometers and the example shown in FIG. 1 is representative only.

The successive reduction in diameter of casing results in a casing with a relatively small ID near the bottom of the borehole 32 at or near a formation payzone. The narrow ID could limit the amount of hydrocarbons that can be recovered. In addition, the relatively large diameter borehole 10 at the top of the well involves increased costs due to the large drill bits required, heavy equipment for handling the larger casing, and increased volumes of drill fluid that are required.

Once the casing portions 16, 22, 28, 34 have been cemented into place, the borehole is then "completed". This involves installing a completion string 38 within the IDs of the casing portions 16, 22, 28, 34. The OD of the completion string 38 is thus limited by the ID of the lowermost casing 34, which in turn is limited by the IDs of the casings 16, 22, 28 above, and this can limit the amount of hydrocarbons that can be recovered from a reservoir 40. The completion string 38 is typically of a corrosion resistant material as corrosive chemicals in the formation 12 and/or the reservoir 40 such as $H_2S$ can be mixed with the hydrocarbons from the reservoir 40 flowing up through the string 38 to the surface 14. The flow of hydrocarbons is indicated schematically by arrows 42 in FIG. 1.

A packer 44 or the like is used at or near a lower end of the lowermost casing 34 to isolate the annulus and thus prevent hydrocarbons from flowing up it. Also, a safety valve (not shown) is typically located in the completion string 38 at or near an upper end thereof, and is used to prevent the flow of hydrocarbons to the surface in the event of an emergency, as is known in the art. The completion string 38 may also contain various flow control devices to control the flow of hydrocarbons, and downhole sensing and measuring apparatus to monitor the flow rate, temperature and other parameters of the produced fluids.

SUMMARY OF THE INVENTION

According to a first aspect of the present invention there is provided a method of drilling and casing a borehole, the method comprising the steps of a) drilling a portion of the borehole into a formation, b) providing an expandable tubular member, c) running the tubular member into the portion of the borehole, and d) radially expanding the member.

The method preferably includes the additional steps of drilling one or more further portions of the borehole extending from the existing portion of the borehole, providing one or more further expandable members, running the or each expandable member into the or each further portions of the borehole, and radially expanding the or each member in the or each further portion of the borehole. This process can then be repeated until the required depth of the overall borehole is reached.

Preferably, the or each portion of the borehole is drilled at approximately the same diameter as the existing portion(s) of the borehole. Thus, all boreholes are drilled and cased at substantially the same diameter. This is advantageous because it requires only a single sized drill bit to be used instead of a number of different sized bits, and also reduces the amount of time spent in drilling and casing as there is no requirement to change to different sized bits as the borehole increases in depth.

The or each portion of the borehole typically extends the borehole into the formation from the or each existing portion. Alternatively, or additionally, the or each portion of the borehole may comprises one or more lateral and/or horizontal boreholes drilled from the or each existing borehole.

According to a second aspect of the present invention there is provided apparatus for casing a borehole, the apparatus comprising a length of expandable tubular member, and an expander device that is capable of radially expanding the member in the borehole.

A drill bit is typically used to drill the or each portion of the borehole into the formation. The drill bit is typically provided with one or more cutting elements that are preferably capable of assuming a retracted configuration and an extended configuration. In the retracted configuration, the drill bit can be passed through expandable members that have been expanded into contact with the borehole. In the expanded configuration, the drill bit can be used to drill a borehole below an expandable member that has been previously installed. An underreamer may be used, for example.

Alternatively, a single diameter drill bit can be used together with an underreamer.

The or each expandable tubular member can be of a length that is substantially the same length as the or each portion of the borehole. This provides the advantage that the entire length of the or each portion of the borehole can be cased using the same member. The or each length of expandable tubular member can be provided by coupling discrete lengths of expandable tubular member together (e.g. using screw threads), or by using a roll, reel, coil or the like of expandable tubular member. Alternatively, the or each length of tubular member may comprise a plurality of discrete lengths that are inserted into the or each portion of the borehole in an overlapping arrangement so that an upper end of a subsequent member overlaps a lower end of a previous member.

The or each expandable tubular member is typically-radially expanded until at least a portion of an outer surface of the member contacts an inner surface of the or each portion of the borehole. It will be appreciated that the outer surface of the member need not contact the or each portion of the borehole. For example, the expandable tubular member may be provided with a friction and/or sealing material (e.g. rubber) on its outer surface, where the material typically contacts the or each portion of the borehole. Alternatively, the expandable tubular member (with or without a friction and/or sealing material) can be radially expanded within the or each portion of the borehole so that an annulus is created between an outer surface of the member and the or each portion of the borehole, the annulus then being filled with cement to hold the member in place.

Also, one or more spacers or the like may be used between the or each expandable tubular member and the or each portion of the borehole.

The method typically includes-one, some or all of the additional steps of providing an expander device, and running the expander device into the expandable tubular member to radially expand the member.

Optionally, the method includes one, some or all of the additional steps of resting the or each expandable tubular member on a portion of the expander device, and pushing or pulling the expander device though the member to radially expand the member in the or each portion of the borehole.

Optionally, the method includes the additional step of anchoring at least a portion of the member, typically at or near a starting position of the expander device.

The method typically includes the additional steps of providing a drill string, coiled tubing string or the like, and attaching the expander device to the string.

Optionally, the method includes one, some or all of the additional steps of providing a corrosion resistant expandable tubular member, running the corrosion resistant expandable tubular member into the or each portion of the borehole, and radially expanding the corrosion resistant member.

The corrosion resistant member is typically located within the expandable tubular member. The corrosion resistant member is typically radially expanded until a portion thereof (e.g. an outer surface) contacts the expandable tubular member. It will be appreciated that the corrosion resistant member need not contact the expandable tubular member. A spacer or the like may be used therebetween, or a friction and/or sealing material applied to the outer surface of the corrosion resistant tubular member. Also, cement may be used between the members.

The corrosion resistant expandable tubular member is typically of a length that is substantially the same length as the or each-portion of the borehole and/or the or each expandable tubular member. This provides the advantage that the entire length of the or each portion of the borehole can be cased using the same member. The length of the or each corrosion resistant expandable tubular member can be provided by coupling discrete lengths of corrosion resistant expandable tubular members together (e.g. using screw threads), or by using a roll, coil, reel or the like of corrosion resistant expandable tubular member. Alternatively, the length of corrosion resistant tubular member may comprise a plurality of discrete lengths that are inserted into the or each portion of the borehole in an overlapping arrangement so that a lower end of an upper member overlaps an upper end of a subsequent member. The corrosion resistant tubular member typically has a relatively thin wall thickness (e.g. in the order of 5 mm or less).

Typically, at least a portion of the outer surface of the corrosion resistant tubular member contacts an inner surface of the expandable tubular member, although this is not essential.

The corrosion resistant tubular member is typically required where the expandable tubular member is not corrosion resistant so that the hydrocarbons and other production fluids such as corrosive agents can flow up the corrosion resistant tubular member to the surface. Of course, the original expandable tubular member may be of a corrosion resistant material (or coated therewith) and thus there would be no requirement for a second member of corrosion resistant material. Additionally, the expandable tubular member and/or the corrosion resistant tubular member obviate the need to have an internal completion string to facilitate the recovery of hydrocarbons and eliminate an annulus between the completion string and the casing.

Preferably, the method includes the additional step of providing a service string within the expandable tubular member. The service string is typically required as there is no annulus between the conventional completion string and the casing that is typically used for control cables and the like that control operation of various downhole tools and apparatus (e.g. packers, flow control devices, safety valves or the like), and electrical cables, wires etc.

The apparatus optionally includes a corrosion resistant tubular member. This member serves to facilitate the flow of hydrocarbons from a reservoir, well or the like to the surface.

The apparatus preferably includes a service string or the like. The service string is typically located within the expandable and/or corrosion resistant member and is typically used as a conduit to house cables, wires and the like that are typically used to control downhole tools, apparatus and instruments. The service string may be provided with downhole apparatus and instruments (e.g. flow meters, temperature sensors etc).

The recovered hydrocarbons typically flow up an annulus between the service string and the expandable tubular member and/or the corrosion resistant tubular member.

The service string typically comprises a corrosion resistant tubular member. However, the service string may comprise any downhole tubular, such as a string of casing, liner or the like. The service string may comprise a roll or coil of tubing, or can be discrete lengths of preferably corrosion resistant tubular members that are coupled together (e.g. using screw threads). The corrosion resistant tubular member typically has a relatively thin wall thickness (e.g. of around 5 mm or less).

The or each tubular member is preferably manufactured from a ductile material. Thus, the or each tubular member is capable of sustaining plastic deformation.

Typically, the or each tubular member is a casing, liner, drill pipe, pipeline, conduit or the like.

The expander device is typically manufactured from steel, a steel alloy, tungsten carbide etc. Alternatively, the expander device may be manufactured from ceramic, or a combination of steel, ceramic, tungsten carbide etc. The expander device is optionally flexible. The expander device is typically of a material that is harder than the member that is has to expand. It will be appreciated that only the portion(s) of the expander device that come into contact with the member need be of a harder material and/or coated therewith.

The expander device is optionally provided with at least one seal. The seal typically comprises at least one O-ring.

The expander device is typically pushed or pulled through the or each tubular member, pipeline, conduit or the like using fluid pressure. Alternatively, the device may be pigged along the or each tubular member or the like using a conventional pig or tractor. The device may also be pushed using a weight (from the string for example), or may be pulled through the or each tubular member or the like (using drill pipe, rods, coiled tubing, a wireline or the like).

The or each tubular member is optionally temporarily anchored at an upper or lower end thereof using a mechanical or other anchoring device (e.g. a slip or packer), and facilitates radial expansion thereof.

An outer surface of the or each tubular member may be provided with a friction and/or sealing material that enhances the grip on the borehole or other member. The formation typically comprises one or more types of a resilient material.

BRIEF DESCRIPTION OF THE DRAWINGS

Embodiments of the present invention shall now be described, by way of example only, with reference to the accompanying drawings in which:.

DETAILED DESCRIPTION OF THE PREFERRED EMBODIMENT

Figure 2:
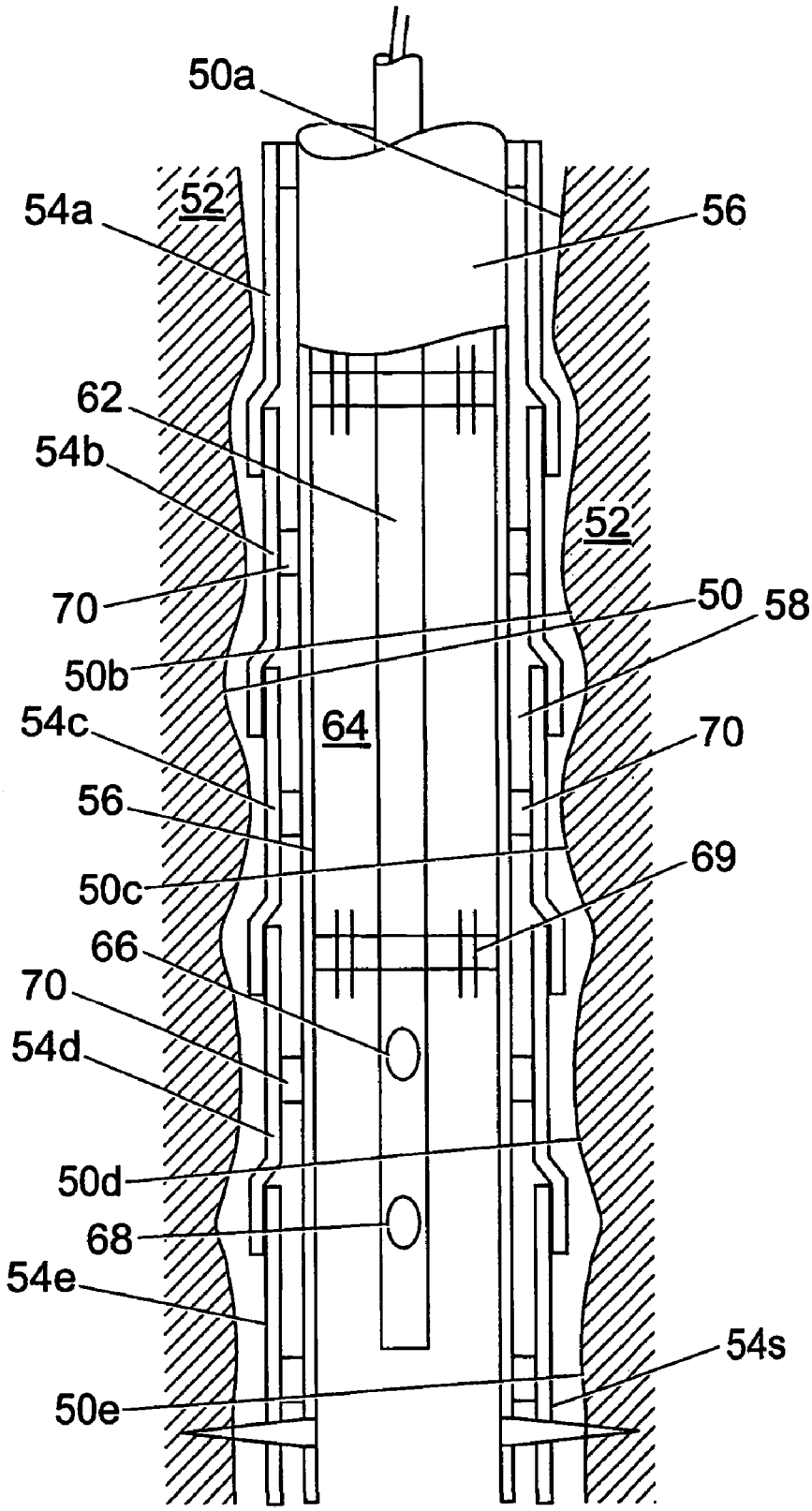
FIG. 2 is an exemplary embodiment of apparatus for casing a borehole.

Referring to the drawings, FIG. 2 shows a particular embodiment of apparatus for casing a borehole 50 that has been drilled into a formation 52 as is known in the art. The borehole 50 generally facilitates the recovery of hydrocarbons (or other fluids) from a reservoir or pay zone (not shown in FIG. 2).

Like conventional methods for drilling boreholes, borehole 50 is made up of a number of individually drilled portions of borehole, illustrated in FIG. 2 as boreholes 50*a* to 50*e*. It will be appreciated that FIG. 2 is not to scale and shows only a portion of the overall borehole 50 and the apparatus, and the number of individual portions of borehole 50*a* to 50*e* that are required will vary depending upon the length or depth of the overall borehole 50.

However, unlike conventional methods, the overall borehole 50 is drilled at a single diameter along its entire length or depth. This is achieved by drilling subsequent portions of borehole 50*b* to 50*e* through the first portion of borehole 50*a* at substantially the same diameter as the first portion of borehole 50*a*. A single diameter bit that is provided with one or more cutting elements can be used, where the or each cutting element is capable of being moved between a retracted configuration and an extended configuration. In this way, the drill bit in the retracted configuration can be inserted through the first portion of borehole 50*a* that has already been drilled and cased, and then the or each cutting element can be moved to the extended configuration (e.g. by applying fluid pressure to the bit). Thus, the subsequent portions of the borehole 50*b* to 50*e* drilled can have substantially the same diameter as the preceding portions of the borehole 50*a* to 50*d*.

The apparatus includes a length of expandable casing 54 that is preferably a single length of casing that is substantially the same length (or depth) as each individual portion of the borehole 50*a* to 50*e*. The casing 54 is shown in FIG. 2 as a number of casing portions of a discrete length with an overlap between each portion. However, it is possible to have the casing 54 made from a single piece of casing so that there is no overlap, although it is also possible to have a number of casing portions that are coupled together (e.g. by welding or screw threads) so that there is no overlap between successive casing portions. The casing 54 may be in the form of a roll, reel or coil of casing as is known in the art.

Casing 54 is preferably manufactured from a ductile material so that it is capable of sustaining plastic and/or elastic deformation. Casing 54 is typically of carbon steel or a corrosion resistant alloy for example.

In use, the first portion of the borehole 50*a* is initially drilled so that the entire length or depth of the first portion of the borehole 50*a* is of substantially the same diameter. The diameter is typically slightly greater than an outer diameter (OD) of the casing 54 in an unexpanded state. The casing 54 is typically capable of sustaining plastic deformation to expand its OD by around 10% at least, although radial plastic deformation in the order of 20% or more is possible. Thus, the diameter of the first portion of the borehole 50*a* (and thus the overall borehole 50) will be dependent upon the material used for the casing 54 and also the percentage of radial plastic deformation. It will be appreciated that use of the term radial plastic deformation is understood to be the use of an expander device (not shown) that is pushed or pulled through the casing 54 to impart a radial expansion force to the casing so that both the ID and the OD of the casing 54 increases.

Once the first portion of the borehole 50*a* has been drilled, it is typically lined or cased to prevent it from collapsing. In its simplest embodiment, a length of expandable casing 54*a* is inserted into the first portion of the borehole 50*a*. The length of the casing 54*a* is substantially the same as the depth or length of the first portion of the borehole 50*a*. After the casing 54*a* has been run into the first portion of the borehole 50*a* , an expander device is then forced through the casing 54*a* to radially expand at least a portion thereof, and preferably the entire length, so that the outer surface of the casing 54 preferably contacts the inner wall of the first portion of the borehole 50*a*. It will be appreciated that the outer surface of casing 54*a* need not contact the inner wall of the first portion of the borehole 50*a*, as will de described.

The length of casing 54*a* may be in a number of different forms, for example, the length of casing 54*a* could be from a roll, reel or coil of expandable tubing. Alternatively, the casing 54*a* can be made up from a plurality of discrete lengths of casing that are coupled together (e.g. by welding, screw threads or the like), or overlapped at each end.

It is preferred, but not essential, that the entire length of the casing 54*a* is expanded in one pass of an expander device (not shown) through the casing 54*a*. The expander device is typically a cone that is forced through the casing 54*a* to impart a radial expansion force to the casing 54*a*. The device can be of metal or a metal alloy (e.g. steel, tungsten carbide), ceramic or a combination of these materials and typically has an OD that is substantially the same as or slightly less than the final required ID of the (expanded) casing 54*a*. In this way, the first portion of the borehole 50*a* can be cased in one trip of the device through the casing 54*a*.

The pliable casing 54*a* undergoes plastic deformation when expanded by the expander device as it is propelled, pushed or pulled through the casing 54*a*. The expander device can be propelled along the casing 54*a* in a similar manner to a pipeline pig and may be pushed (using weight or fluid pressure for example) or pulled (using drill pipe, rods, coiled tubing, a wireline or the like).

The expander device is typically attached to a drill string, coil tubing string or the like and can be inserted into a lower part of the casing 54*a* that has been pre-expanded to house the device. Thereafter, the device is pulled through the casing 54*a* to impart a radial expansion force by pulling the drill string, coiled tubing string etc out of the casing 54*a*. Where the expander device is located in a pre-expanded portion of the casing 54*a*, the casing 54*a* can be rested on top of the device and lowered into the first portion of the borehole 50*a* using the drill string, coiled tubing string or the like.

Alternatively, the expander device can be propelled or pushed through the casing 54*a* using a pig, tractor, fluid pressure or the like. It is possible that the expander device can be located at the top of the casing and propelled (using a tractor) or pushed (using fluid pressure, a drill string, or weight from the string) through the casing 54*a* to impart a radial expansion force thereto.

The casing 54*a* may need to be temporarily anchored in the first portion 50*a* of the borehole 50 using a device, such as a packer, slips or the like. However, where the expander device includes an inflatable element (e.g. a packer), then the inflatable element can be inflated in the pre-expanded portion (or elsewhere) thus forcing it radially outwards into contact with the first portion 50*a* of the borehole 50 and this provides an anchor for pulling the device through the casing 54*a*. The expander device (e.g. a cone) can be releasably attached to the inflatable element so that the inflatable element can be left in the casing 54*a* to act as an anchor during expansion thereof.

The expandable casing 54*a* does not require to be cemented into place as it is typically held against the first portion 50*a* of the borehole 50 due to physical contact between an outer surface of the casing 54*a* and an inner wall of the first portion 50*a* of the borehole 50, although cementing remains an option. The casing 54*a* need not contact the borehole 50 itself; it may be provided with a friction and/or sealing material, or other type of spacer or seal, between the casing 54*a* and the first portion 50*a* of the borehole 50. Thus, significant savings in terms of rig time and costs are provided as it is no longer necessary to cement each length of conventional casing into place, the cement typically being left for several hours to cure. As each casing is of a different diameter, a borehole of equivalent or slightly larger diameter must be drilled into the formation for each diameter of casing which is then cemented into place, taking several hours to cure.

Once the first portion 50*a* of the borehole 50 has been drilled and the casing 54*a* installed, as described above, a second portion 50*b* of the borehole 50 is then drilled. The second portion 50*b* of the borehole 50 can be drilled using an expandable bit (e.g. a drill bit that is capable of assuming two different configurations). The expandable bit typically has a plurality of cutting elements that can be moved between first and second configurations. In the first configuration, the cutting elements are typically retracted so that the drill bit can be passed through the bore of previously drilled boreholes and/or pre-installed casings, liners etc. Once the bit has passed through the bores, the cutting elements can then be extended (e.g. by fluid pressure, centrifugal force or the like) to assume a cutting diameter that is slightly greater than the final or expanded outer diameter of the casing, liner etc.

Alternatively, the or each borehole portion 50*b* to 50*e* can be drilled using a drill bit of a fixed diameter, and then an underreamer used to enlarge the bore below a pre-installed portion of casing to allow a second casing to be installed therebelow.

Thus, the second portion 50*b* of the borehole 50 is drilled at substantially the same diameter as the first portion 50*a* of the borehole 50. Thus, there is no requirement to provide drill bits of varying cutting diameter to produce boreholes that reduce in diameter as the length or depth of the borehole increases, thus saving costs. Further, there is no requirement to provide casing or liner having different diameters, again saving costs. Further cost and time savings can be made as there is no requirement to change drill bits to vary the cutting diameter and the time taken to perform this.

Having drilled the second portion 50*b* of the borehole 50, a second casing 54*b*, similar to casing 54*a*, is then installed and expanded into place as described above with reference to casing 54*a*. This has significant advantages as the casing 54*a*, 54*b* can be expanded sufficiently so that an outer surface 54*s* of each casing 54*a*, 54*b* contacts an inner wall of the borehole portions 50*a*, 50*b*. Consequently, the casing 54*a*, 54*b* is held in places due to frictional contact with the wall of the borehole portions 50*a*, 50*b*. Indeed, the casings 54*a*, 54*b* can be expanded sufficiently so that they deform into the formation 52 and remain in place due to compression of the formation 52. This is advantageous because the casing 54*a*, 54*b* can be held in place without the use of cement. This, there is no requirement to cement the casing 54*a*, 54*b* in place, thereby saving time and costs because the borehole portions 50*a*, 50*b* does not require to be left for several hours for each casing 54*a*, 54*b* to allow the cement to cure before further boreholes can be drilled.

A third portion 50*c* of the borehole 50 is then drilled and cased using casing 54*c* in a similar manner to that described above. Further portions 50*d*, 50*e* of the borehole 50 can then be drilled and cased using casing 54*d*, 54*e* and so on until the overall borehole 50 is at the required depth or length. Thus, the entire borehole 50 is drilled at substantially the same diameter over the full length or depth. Further advantages of embodiment of the present invention is that the entire length or depth of the overall borehole 50 can have a diameter that is sufficient to facilitate effective and non-restricted production of hydrocarbons and other fluid therefrom. This means that production from the borehole 50 can be increased, without adding to the costs and providing time savings in gaining access to the pay zone.

It will be appreciated that an upper end of the subsequent casings 54*b* to 54*e* typically overlap a lower end of the previously installed casing (e.g. casing 54*a*), as shown in FIG. 2.

It will be noted that drilling the borehole 50 at a single diameter over its entire length using individual borehole portions 50*a* to 50*e* of substantially the same diameter, has other advantages over the conventional method described with reference to FIG. 1. In particular, the large drill bits and heavy equipment that are typically used towards the upper end of the borehole are not required, thus significantly reducing the costs. Other benefits and advantages include environmental benefits as less rock/cuttings are removed from the borehole that require to be disposed of. Also, only a borehole of one diameter is required. Thus, there is no requirement to drill a borehole of a first diameter using a relatively large drill bit and then drilling subsequent lower boreholes with drill bits that gradually reduce in diameter as the depth of the borehole increases. This significantly reduces the costs as less rig time is required because the requirement to periodically change a drill bit to a different sized bit is obviated. Furthermore, only a single-sized borehole is required and thus a plurality of different sized drill bits are not generally required, which also reduces costs. The rig time for drilling the borehole is substantially reduced with respect to conventional methods, as only a single diameter hole need be drilled over the entire length of the borehole. Thus, the method of the present invention provides significant costs and timesavings as only a single diameter borehole need be drilled, and the borehole can be cased using a casing that has a substantially constant diameter over its entire length. As there is no requirement to drill, case and then cement in a cascaded manner, the savings in terms of costs and rig time, rig power, rig size etc are considerable over conventional methods. The outer surface of the casing 54 may optionally be provided with a friction and/or sealing material. In this case, the friction and/or sealing material can be used to enhance the grip of the outer surface of the casing on the inner wall of the or each portion 50*a* to 50*e* of the borehole 50. Any suitable type of rubber or other resilient material can be used for this purpose.

Referring to FIG. 3, there is shown a formation generally designated 70, of a friction and/or sealing material that may be applied to an outer surface 54*s* of the casing 54 thereof. The formation 70 typically comprises first and second bands 72, 74 that are axially spaced-apart along a longitudinal axis of the casing 54. The first and second bands 72, 74 are typically axially spaced by some distance, for example 3 inches (approximately 76 mm). The first and second bands 72, 74 are preferably annular bands that extend circumferentially around the outer surface 54*s* of the casing 54, although this configuration is not essential. The first and second bands 72, 74 typically comprise 1-inch wide (approximately 26 mm) bands of a first resilient material (e.g. a first type of rubber). The formation 70 need not extend around the full circumference of the surface 54*s*.

Located between the first and second bands 72, 74 is a third band 76 of a second resilient material (e.g. a second type of rubber). The third band 76 preferably extends between the first and second bands 72, 74 and is thus typically 3 inches (approximately 76 mm) wide.

The first and second bands 72, 74 are typically of the same depth as the third band 76, although the first and second bands may be of a slightly larger depth.

The first type of rubber (i.e. first and second bands 72, 74) is preferably of a harder consistency than the second type of rubber (i.e. third band 76). The first type of rubber is typically 90 durometer rubber, whereas the second type of rubber is typically 60 durometer rubber. Durometer is a conventional hardness scale for rubber. The particular properties of the rubber or other resilient material may be of any suitable type and the hardnessess quoted are exemplary only. It should also be noted that the relative dimensions and spacing of the first, second and third bands 72, 74, 76 are exemplary only and may be of any suitable dimensions and spacing.

Figures 3A, 3B, 3C:
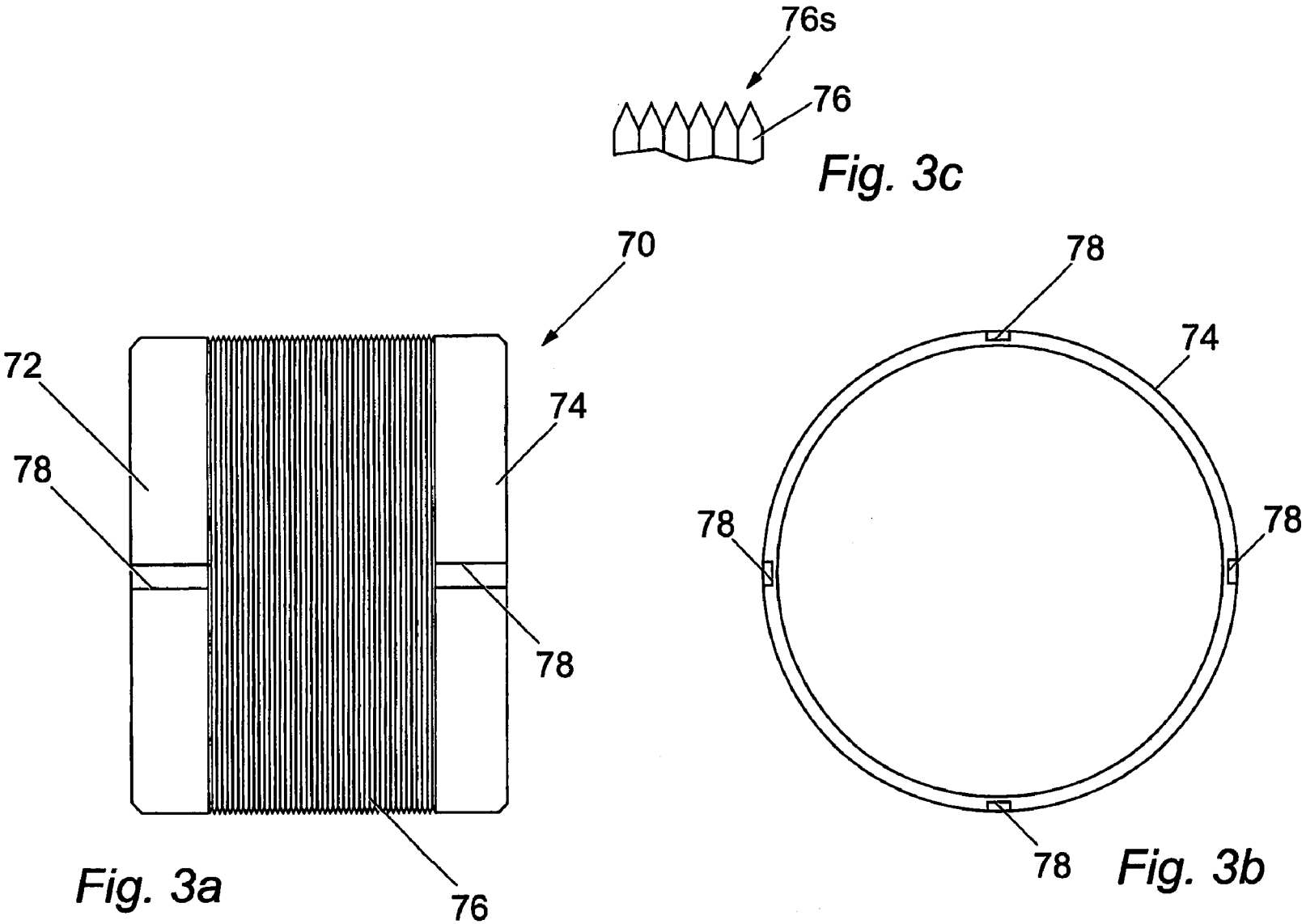
FIG. 3*a* is a front elevation showing a first configuration of a formation that can be applied to an outer surface of a portion of the apparatus of FIG. 2.
FIG. 3*b* is an end elevation of the formation of FIG. 3*a*.
FIG. 3*c* is an enlarged view of a portion of the formation of FIGS. 3*a* and 3*b* showing a profiled outer surface.

As can be seen from FIG. 3*c* in particular, an outer face 76*s* of the third band 76 can be profiled. The outer face 76*s* is ribbed to enhance the grip of the third band 76 on the borehole in which the casing 54 is located. It will be appreciated that an outer surface of the first and second bands 72, 74 may also be profiled (e.g. ribbed). The ribbed profile also helps when the casing 54 is expanded as it provides a space into which the compressed rubber can extend or deform into, as rubber is generally incompressible.

The two outer bands 72, 74 being of a harder rubber provide a relatively high temperature seal and a back-up seal to the relatively softer rubber of the third band 76. The third band 76 typically provides a lower temperature seal.

The two outer bands of rubber 72, 74 are provided with a number of circumferentially spaced-apart notches 78. In the embodiment shown, four equidistantly spaced notches 78 are provided, and as can be seen from FIG. 3*b* in particular, the notches 78 do not extend through the entire depth of the rubber bands 72, 74. The notches 78 are used because the bands 72, 74 are of a relatively hard rubber material and this may stress, crack or break when the outer diameter of the casing 54 is radially expanded. The notches 78 provide a portion of the bands 72, 74 that is of lesser thickness than the rest of the bands 72, 74 and this portion can stretch when the casing 54 is expanded. The stretching of this portion substantially prevents the bands 72, 74 from cracking or breaking when the casing 54 is expanded. The notches 78 also provide a space into which the rubber may deform or expand into when the casing 54 is expanded.

Figure 4B:
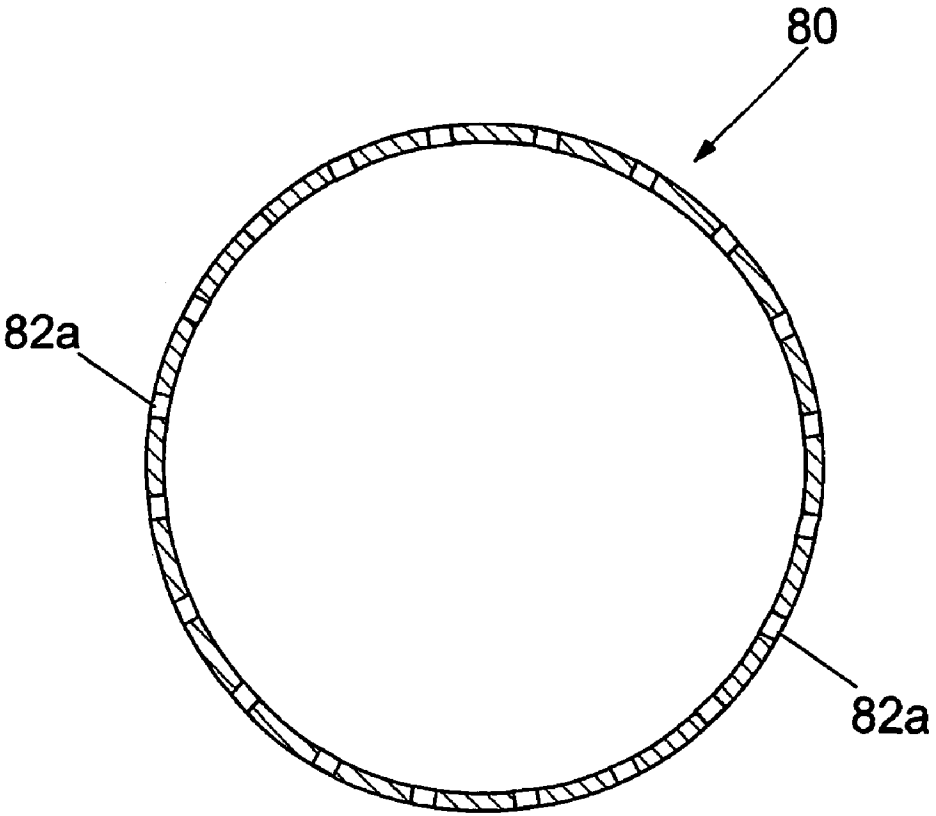
FIG. 4*b* is an end elevation of the formation of FIG. 4*a*.
Figure 4A:
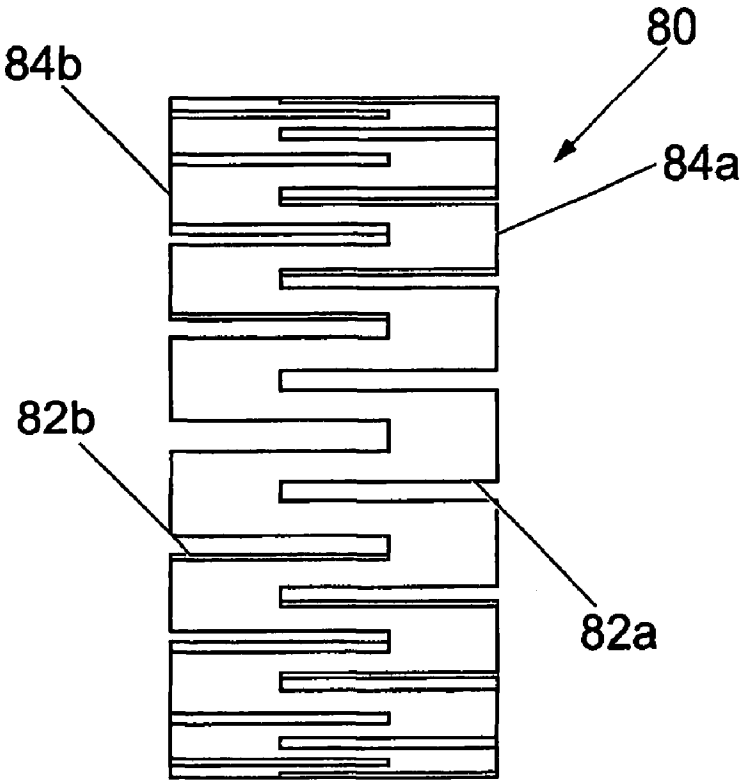
FIG. 4*a* is a front elevation of an alternative formation that can be applied to an outer surface of a portion of the apparatus of FIG. 2.

In use, the formation 70 is applied to the outer surface 54*s* of the (unexpanded) expandable casing 54. The formation 70 may be applied at axially spaced-apart locations along the length of the casing 54, the spacing and number of formations 70 being chosen to suit the particular application. An alternative formation 80 that can be applied to the outer surface 54*s* of the casing 54 is shown in FIGS. 4*a* and 4*b*. The alternative formation 80 is in the form of a zigzag. In this embodiment, the formation 80 comprises a single (preferably annular) band of resilient material (e.g. rubber) that is, for example, of 90 durometers hardness and about 2.5 inches (approximately 28 mm) wide by around 0.12 inches (approximately 3 mm) deep.

To provide a zigzag pattern and hence increase the strength of the grip and/or seal that the formation 80 provides in use, a number of slots 82*a*, 82*b* (e.g. 20 in number) are milled into the band of rubber. The slots 82*a*, 82*b* are typically in the order of 0.2 inches (approximately 5 mm) wide by around 2 inches (approximately 50 mm) long.

The slots 82*a* are milled at around 20 circumferentially spaced-apart locations, with around 18° between each along one edge 84*a* of the band. The process is then repeated by milling another 20 slots 82*b* on the other side 84*b* of the band, the slots 82*b* on the other side 84*b* being circumferentially offset by 9° from the slots 82*a* on the first side 84*a*. The slots 82*a*, 82*b* also provide a space into which the rubber of the formation 80 can expand or deform into when the casing 54 is expanded.

In use, the formation 80 is applied to the outer surface 54*s* of the expandable casing 54, as with formation 70. The formation 80 may be applied at a plurality of axially spaced-apart locations along the length of the casing 54, the spacing and number of formations 80 being chosen to suit the particular application.

It is preferable that the casing 54 be made of a corrosion resistant material so that the casing 54 can also be used as a production string up which hydrocarbons from the reservoir may flow to the surface. Of course, casing 54 may be coated with a corrosion resistant material. However, where this is not possible, it will be necessary to insert an additional length of cladding 56 that is of a corrosion resistant material inside the casing 54, as shown in FIG. 2. It should be noted that the corrosion resistant cladding 56 is not essential.

The cladding 56 is preferably also of a ductile material that is also a corrosion resistant material so that it can be inserted into the casing 54 and radially expanded so that its OD contacts the ID of the casing 54. In this way, the overall borehole 50 (or portions thereof) can be lined with casing 54 and clad with cladding 56 by installing the casing 54 as described above, and then the cladding 56 is inserted into the casing 54 and then radially expanded so that it contacts an inner surface of the casing 54. Again, the cladding 56 need not contact the casing 54 as spacers or the like may be provided. Also, cement can optionally be used to fill the annulus between the casing 54 and the cladding 56.

Cladding 56 is typically relatively thin (e.g.-with a wall thickness of around 5 mm or less) so that it is easy to radially expand, and also so that it does not adversely affect the size of the conduit through which the recovered hydrocarbons flow to the surface. Thus, the cladding 56 does not restrict the flow rate of the recovered hydrocarbons or other fluids.

It will be appreciated that the cladding 56 may be provided with formation 70, formation 80 or the like to provide a seal in the annulus 58 between the cladding 56 and casing 54, as illustrated in FIG. 2. It will be generally appreciated that a seal in the annulus 58 will not be required where the cladding 56 is expanded to fully contact the casing 54 as there will be no annulus. The seals provided by, for example, formations 70, 80 or any conventional method (e. g. a packer) prevent hydrocarbons from the reservoir or well flowing up the annulus 58 and being lost into the surrounding formation.

Thus, the method may include the additional step of providing a length of cladding 56 where it is required to have a corrosion resistant material in the borehole 50 (e.g. if the casing 54 is not corrosion resistant or provided with a corrosion resistant coating). The cladding 56 can be the same length as the overall borehole 50, but it will be appreciated that the length of cladding 56 may comprise a number of discrete portions, or,may be in the form of a coil, reel or roll for example. The cladding 56 is then run into the casing 54 and radially expanded. The cladding 56 can be radially expanded in the same way as the casing 54 e.g. by pushing, pulling or otherwise propelling the expander device therethrough.

Figure 1:
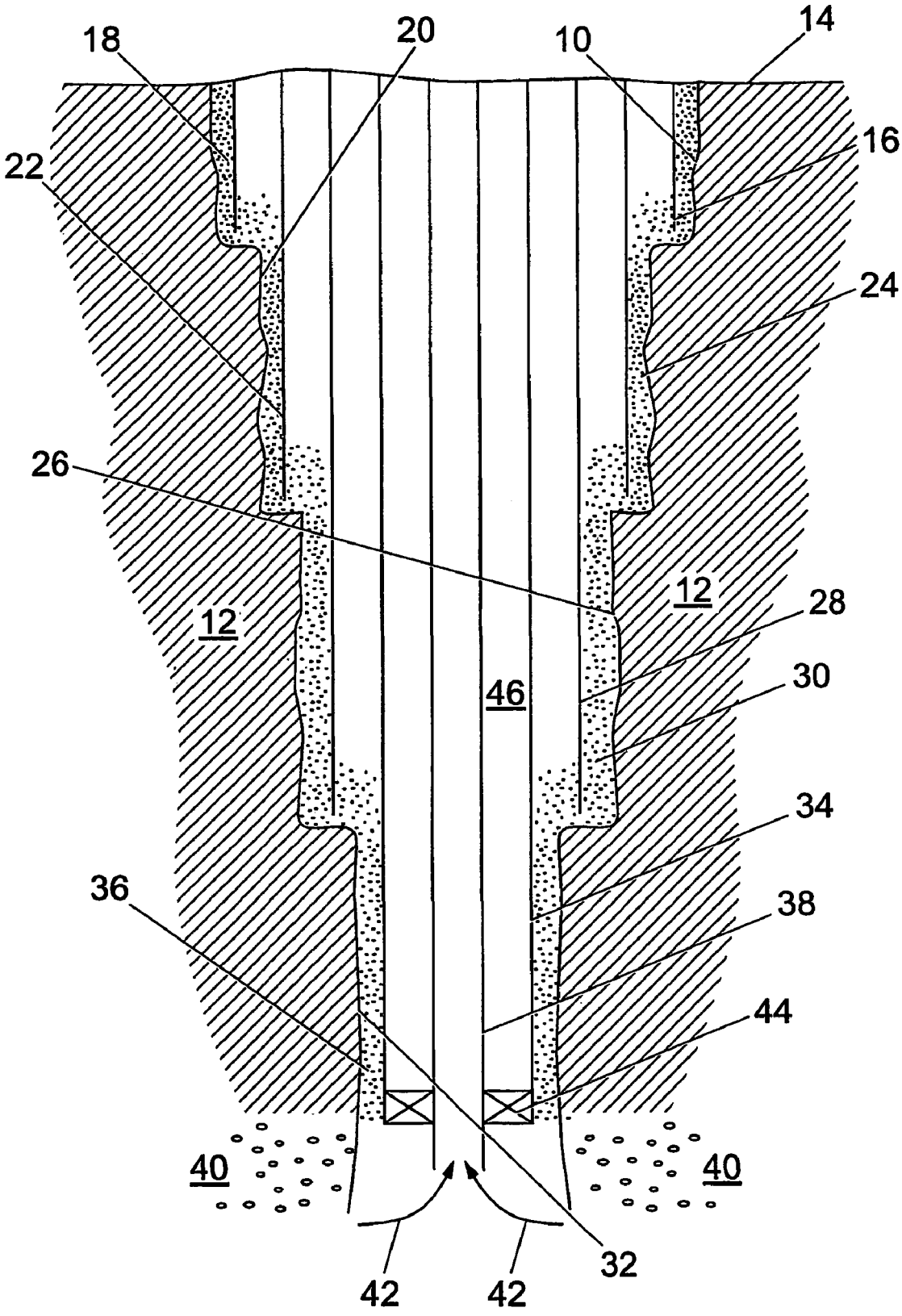
FIG. 1 is a schematic representation of a prior art method of drilling and casing a borehole.

The conventional method of drilling and completing a borehole generally provides a production annulus 46 between the production string 38 and the casing 34 (FIG. 1). The production annulus 46 is typically used to run control lines, wires etc from the surface to downhole, the lines etc being used for many different purposes such as transmitting power and data communications from the surface to apparatus located downhole.

The production annulus 46 typically acts as a service conduit also, that is it is usually used to gain access for remedial and repair operations.

Also, the service conduit is used to house cabling and downhole apparatus and instruments (e.g. flow sensors, temperature sensors and associated cabling etc) that monitor various parameters of the recovered hydrocarbons.

The service conduit (i.e. production annulus 46) is generally limited in size resulting in space and design constraints for the type of apparatus, instruments and cabling that can be inserted therein. The size limitation also presents other problems, such as making the annulus 46 difficult to access and it is also difficult to install downhole apparatus and instruments, cabling etc. The apparatus, instruments and cabling are often damaged as they are being run into the annulus 46, and there is also difficulty in passing the apparatus etc through pressure barriers such as packers.

If the apparatus or instruments fail or break down during installation or use, they must be retrieved from the annulus, which can be very expensive and time consuming.

Referring to FIG. 2, it will be noted that an annulus 58 is provided in the particular embodiment shown in FIG. 2, and this can be used for the control lines etc. However, there may be situations where there is no annulus 58 between the cladding 56 and the casing 54, for example where the casing 54 is also corrosion resistant so that the cladding 56 is not required, or where the cladding 56 is radially expanded to fully contact the inner surface of the casing 54 or cement is used to fill the annulus 58.

Thus, the present invention also provides a service string 62 that is located within the cladding 56 in the embodiment shown. It will be noted that the service string 62 can be provided within the casing 54 where no cladding 56 is used. The service string 62 is of a relatively small OD so that it does not provide an obstruction to the hydrocarbons that will flow up an annulus 64 between the service string 62 and the cladding 56 (or casing 54).

The service string 62 can be a string of any downhole tubular member, but is preferably in the form of a coil, roll or reel so that it can be easily dispensed and retrieved from the borehole 50.

The service string 62 is used to house the control wires, lines etc and any other control or electrical cables that are used to control or provide signals to and from downhole apparatus. The service string 62 may incorporate the downhole apparatus and instruments, such as flow sensors 66 or intra-well sensors 68 etc. Thus, the service string 62 could house cabling that is between the downhole sensors 66, 68 and the surface. The service string 62 may also be used for chemical injection and gas lift.

Also, the annulus 64 may contain other downhole apparatus or instruments, such as flow control devices 69 or the like. Thus, the service string 62 can be used to house any cabling between the flow control device 69 and the surface so that the device 69 or other apparatus can be controlled and monitored.

Where a service string 62 is required, the method typically includes the additional steps of providing the service string 62 within the casing 54 or the cladding 56. The service string 62 is typically held within the casing 54 or the cladding 56 using any conventional means, e.g. seals, a packer or the like. The service string 62 can comprise a number of discrete portions of drill string for example, or could be a length of coiled tubing or the like.

Thus, the invention in certain embodiments provides a method and apparatus for casing a borehole that provides significant advantages over conventional methods. In particular, the method and apparatus of the invention in certain embodiments provide savings in terms of costs and rig time, and also obviate the need to drill different sized boreholes for each OD of casing. Additionally, there is no requirement to cement the casing into place as it is radially expanded to contact the borehole and is generally held in place due to a frictional contact between the casing and the borehole.

The service string in certain embodiments offers advantages over the conventional method because it provides a housing for downhole apparatus and instruments that can be pre-installed before the string is run into the borehole. Thus, the instruments, cabling etc are protected as they are run into the borehole by the service string. Also, if the instruments, apparatus etc within the service string fail or break down, the service string can be easily withdrawn from the borehole and the instruments, apparatus etc repaired or replaced before the string is run back into the borehole.

It will also be appreciated that embodiments of the present invention facilitate easy repair of damaged portions of casing, lining or cladding. The service string (where used) would be pulled out of the borehole, and a portion of casing, lining or cladding inserted into the borehole. The portion of casing, liner or cladding is located at or near the damaged portion that is to be repaired, and preferably straddles the damaged portion. Thereafter, the portion of casing, liner or cladding is then radially expanded using an expander device or an inflatable element (e.g. a packer) so that the portion of casing, liner or cladding is radially expanded and thus overlays the damaged portion of casing, liner or cladding. The entire length of the casing, liner or cladding need not be fully expanded, and the casing, liner or cladding can be tied back to the damaged portion by expanding each end thereof (e.g. using an inflatable packer). However, the portion of casing, liner or cladding that is not fully expanded will typically cause a restriction in the path of the hydrocarbons (or other fluids) that are being recovered, which could limit the rate at which the hydrocarbons (or other fluids) can be recovered.

The portion of casing or cladding that is used for the repair is typically a thin-walled tubular with a wall thickness of 5 mm or less so that there is no material change to the diameter of the annulus created between the service string and the cladding up which the hydrocarbons flow. Thus, there is no adverse affect on the flow rate of the recovered hydrocarbons.

Certain embodiments of the invention also provide advantages, as repair or maintenance (e.g. remedial) operations to the borehole, formation etc are simpler because a relatively large diameter of casing can be used along the entire length of the borehole. In conventional systems, these types of operation have to be performed from within the completion string. Restrictions in the ID of the completion string, for example due to safety valves, sensors and the like, can make these operations difficult. Certain embodiments of the present invention provide an unrestricted ID of casing so that the repair operations etc can be undertaken more easily. Even where a service string is used with the present invention, this is relatively small and can be removed to facilitate the repair operations etc, and thereafter replaced.

Modifications and improvements may be made to the foregoing without departing from the scope of the present invention. For example, the tubular members described herein have been radially expanded using an expander device that imparts a plastic deformation to expand the member. It will be generally appreciated that the members can undergo radial expansion, where only a discrete length of the member is expanded using an inflatable device (e.g. a packer). Thereafter, the inflatable device is moved to an unexpanded portion and inflated to radially expand the next portion and so on.

The invention claimed is:

1. A method of drilling and/or casing a borehole, the method comprising the steps of:

drilling a first portion of the borehole into a formation;

providing a drill bit to drill the portion of the borehole into the formation, wherein the drill bit is provided with at least one cutting element that is capable of being moved between a retracted configuration and an extended configuration;

moving the at least one cutting element between the retracted configuration and the extended configuration, wherein the step of moving the at least one cutting element includes applying pressurized fluid to the drift bit;

providing an expandable tubular member;

running the expandable tubular member into the first portion of the borehole; and radially expanding the member.

2. The method according to claim 1, wherein the expandable tubular member is radially expanded until at least a portion of an outer surface of the expandable tubular member contacts an inner surface of the first portion of the borehole.

3. The method according to claim 1, wherein the expandable tubular member is radially expanded within the first portion of the borehole so that an annulus is created between an outer surface of the expandable tubular member and the first portion of the borehole, and the method includes the additional step of filling the annulus with cement to hold the expandable tubular member in place.

4. The method according to claim 1, the method including the additional step of providing a service string within a tubular member selected from the group consisting of the expandable tubular member and a corrosion resistant expandable tubular member.

5. The method of claim 1, further comprising:

running a service string within the expandable tubular member, wherein the service string houses a control line; and flowing hydrocarbons through an annulus between the service string and the expandable tubular member.

6. The method of claim 1, further comprising:

running a service string within the expandable tubular member; and flowing hydrocarbons through an annulus between the service string and the expandable tubular member while using the service string for gas lift.

7. The method according to claim 1, the method including the additional steps of drilling at least one further portion of the borehole extending from the first portion of the borehole, providing at least one further expandable member, running the further expandable member into the further portion of the borehole, and radially expanding the expandable member in the further portion of the borehole.

8. The method according to claim 7, wherein the further portion of the borehole is drilled at approximately the same diameter as the existing portion of the borehole.

9. The method according to claim 7, wherein the further portion of the borehole extends into the formation from the existing portion.

10. The method according to claim 7, wherein the further portion of the borehole comprises at least one borehole selected from the group consisting of lateral and horizontal boreholes drilled from the existing borehole.

11. The method according to claim 1, wherein the step of radially expanding the expandable tubular member includes the additional steps of providing an expander device, and running the expander device into the expandable tubular member to radially expand the expandable tubular member.

12. The method according to claim 11, wherein the step of running the expander device includes the step of moving the expander device through the expandable tubular member to radially expand the expandable tubular member in the first portion of the barehole.

13. The method according to claim 11, wherein the method includes the additional step of resting the or each expandable tubular member on a portion of the expander device whilst the expandable tubular member and the expander device are run into the first portion of the borehole.

14. The method according to claim 11, wherein the method includes the additional step of anchoring at least a portion of the expandable tubular member at a starting position of the expander device.

15. The method according to claim 1, the method including the additional steps of i) providing a corrosion resistant expandable tubular member; ii) running the corrosion resistant expandable tubular member into the portion of the borehole; and iii) radially expanding the corrosion resistant expandable tubular member.

16. The method according to claim 15, wherein the method includes repeating steps i) to ii).

17. The method of claim 1, further comprising cladding at least a portion of the inner surface of the expandable tubular member with a layer of corrosion resistant material.

18. The method of claim 17, further comprising:

running a service string within the expandable tubular member, wherein the service string houses a control line; and flowing hydrocarbons through an annulus between the service string and the layer of corrosion resistant material.

19. A method of drilling and/or casing a borehole, comprising:

drilling a first portion of the borehole into a formation;

providing a drill bit to drill the first portion of the borehole into the formation, wherein a single diameter drill bit is used to drill the first portion of the borehole;

providing an expandable tubular member;

running the expandable tubular member into the first portion of the borehole;

radially expanding the member; and providing an underreamer, running the underreamer into a further portion of the borehole, and actuating the underreamer to increase the diameter of the further portion of the borehole.

20. The method of claim 19, wherein the single diameter drill bit is used to drill the further portion of the borehole.

21. The method of claim 19, further comprising:

running a service conduit within the expandable tubular member; and flowing hydrocarbons through an annulus between the service string and the expandable tubular member while using the service string for gas lift.

22. The method of claim 19, further comprising cladding at least a portion of the inner surface of the expandable tubular member with a layer of corrosion resistant material.

23. The method of claim 22, further comprising:

running a service string within the expandable tubular member, wherein the service string houses a control line; and flowing hydrocarbons through an annulus between the service string and the layer of corrosion resistant material.

24. The method of claim 19, further comprising:

running a service string within the expandable tubular member, wherein the service string houses a control line; and flowing hydrocarbons through an annulus between the service string and the expandable tubular member.

25. The method of claim 24, wherein the service string includes a flow sensor coupled to the control line.

26. The method of claim 24, further comprising disposing a flow control device within the annulus.

27. A method of drilling and casing a borehole, comprising:

running an expandable drill bit through previously installed tubing in the borehole while the bit is in a retracted configuration;

thereafter, extending cutting elements of the expandable drill bit to assume an extended configuration with a cutting diameter greater than the outer diameter of the previously installed tubing;

drilling with the bit in the extended configuration to extend a length of the borehole, thereby forming a lengthened portion of the borehole;

running an expandable tubular member into the lengthened portion of the borehole; and radially expanding the tubular member.

28. The method of claim 27, further comprising:

running a service string within the expandable tubular member, wherein the service string houses a control line; and flowing hydrocarbons through an annulus between the service string and the expandable tubular member.

29. The method of claim 27, further comprising:

running a service string within the expandable tubular member; and flowing hydrocarbons through an annulus between the service string and the expandable tubular member while using the service string for gas lift.

30. The method of claim 27, wherein extending the cutting elements includes applying pressurized fluid to the bit.

31. The method of claim 27, wherein extending the cutting elements includes applying centrifugal force to the bit.

32. The method of claim 27, further comprising cladding at least a portion of the inner surface of the expandable tubular member with a layer of corrosion resistant material.

33. The method of claim 32, further comprising:

running a service string within the expandable tubular member, wherein the service string houses a control line; and flowing hydrocarbons through an annulus between the service string and the layer of corrosion resistant material.

34. A method of drilling and casing a borehole, comprising:

running an expandable drill bit through previously installed tubing in the borehole while the bit is in a retracted configuration;

thereafter, extending cutting elements of the expandable drill bit to assume an extended configuration with a cutting diameter greater than an outer diameter of the previously installed tubing;

drilling with the bit in the extended configuration to extend a length of the borehole, thereby forming a first lengthened portion of the borehole;

running a first tubular member into the first lengthened portion of the borehole;

radially expanding the first tubular member; and recommencing drilling as before to further extend the borehole in length below the first tubular member, thereby forming a second lengthened portion of the borehole having a diameter substantially the same as the first lengthened portion of the borehole.

35. The method of claim 34, wherein extending the cutting elements includes applying pressurized fluid to the bit.

36. The method of claim 34, wherein extending the cutting elements includes applying centrifugal force to the bit.

37. The method of claim 34, further comprising expanding a second tubular member within the second lengthened portion of the borehole.

* * * * *